US007168889B2

(12) United States Patent
Hanna et al.

(10) Patent No.: US 7,168,889 B2
(45) Date of Patent: Jan. 30, 2007

(54) FLOATING PLATFORM HAVING A SPOOLABLE TETHER INSTALLED THEREON AND METHOD FOR TETHERING THE PLATFORM USING SAME

(75) Inventors: Shaddy Y. Hanna, Houston, TX (US); Mamdouh M. Salama, Ponca City, OK (US)

(73) Assignee: Conocophillips Company, Houston, TX (US)

( * ) Notice: Subject to any disclaimer, the term of this patent is extended or adjusted under 35 U.S.C. 154(b) by 629 days.

(21) Appl. No.: 10/131,663

(22) Filed: Apr. 24, 2002

(65) Prior Publication Data

US 2002/0176747 A1 Nov. 28, 2002

Related U.S. Application Data

(60) Provisional application No. 60/286,885, filed on Apr. 27, 2001.

(51) Int. Cl.
*B63B 21/00* (2006.01)
*B63B 35/44* (2006.01)

(52) U.S. Cl. ..... 405/223.1; 405/224; 114/264

(58) Field of Classification Search ..... 405/223.1, 405/224, 224.1, 224.2, 224.3, 224.4, 226, 405/195.1; 114/264, 256
See application file for complete search history.

(56) References Cited

U.S. PATENT DOCUMENTS 2,988,893 A * 6/1961 Borrmann et al. ..... 405/226
3,512,367 A 5/1970 McLallen, Jr. ..... 61/72.3
3,563,042 A 2/1971 Ryan
3,653,085 A * 4/1972 Rovner ..... 441/6
3,976,021 A 8/1976 Blenkarn et al.
4,170,186 A * 10/1979 Shaw ..... 114/264
4,352,599 A 10/1982 Goldsmith
4,354,446 A 10/1982 Goldsmith et al.
4,358,219 A * 11/1982 Burns ..... 405/223.1

(Continued)

FOREIGN PATENT DOCUMENTS

GB 2245287 1/1992
GB 2363617 2/2002

OTHER PUBLICATIONS

Stig Botker, Turid Storhaug, and Mamdouh M. Salama, "Composite Tethers and Risers in Deepwater Field Development: Step Change Technology," Apr. 30-May 3, 2001, pp. 1-10, Offshore Technology Conference.

(Continued)

*Primary Examiner*—Frederick L. Lagman
(74) *Attorney, Agent, or Firm*—Conley Rose, P. C.

(57) ABSTRACT

The present invention discloses a process for installing a floating platform to the ocean floor using a spoolable (preferably composite) tether, comprising installing the spooled tether onto the floating platform; towing the floating platform to a site for installation; unspooling the tether; connecting a bottom end connector of the tether to a foundation on the ocean floor; and connecting a top end connector of the tether to the floating platform. A preferred floating platform is a tension leg platform, and the invention includes a novel tension leg platform (TLP) comprising a spooled tether installed thereon. In a preferred embodiment the foundation is a suction anchor, and the suction anchor is connected to the bottom end connector prior to unspooling the tether and attached to the ocean floor after unspooling the tether. The floating platform may be uninstalled, moved and re-installed according to the invention.

40 Claims, 11 Drawing Sheets

U.S. PATENT DOCUMENTS

| | | | | |
|---|---|---|---|---|
| 4,386,874 | A | 6/1983 | Engelsen et al. | |
| 4,420,276 | A | 12/1983 | Roberts | 405/224 |
| 4,432,671 | A * | 2/1984 | Westra et al. | 405/226 |
| 4,449,850 | A * | 5/1984 | Cessou et al. | 405/60 |
| 4,453,843 | A * | 6/1984 | Martyniuk | 43/57.3 |
| 4,589,801 | A | 5/1986 | Salama | 405/224 |
| 4,768,455 | A | 9/1988 | Maxson et al. | 114/264 |
| 4,936,710 | A * | 6/1990 | Petty et al. | 405/224 |
| 4,938,632 | A | 7/1990 | Eie | 405/224 |
| 4,958,805 | A | 9/1990 | Willamsson | 254/332 |
| 4,983,073 | A * | 1/1991 | Petty et al. | 405/224 |
| 4,990,030 | A | 2/1991 | Salama et al. | 405/224 |
| 4,995,762 | A * | 2/1991 | Goldman | 405/223.1 |
| 5,007,029 | A * | 4/1991 | Scott | 114/293 |
| 5,073,135 | A * | 12/1991 | Parks | 441/6 |
| 5,092,713 | A | 3/1992 | Salama | 405/224 |
| 5,114,276 | A * | 5/1992 | Dupin | 405/224 |
| 5,147,148 | A * | 9/1992 | White et al. | 405/223.1 |
| 5,174,687 | A | 12/1992 | Dunlap et al. | |
| 5,234,365 | A * | 8/1993 | Cooper et al. | 441/11 |
| 6,012,873 | A * | 1/2000 | Copple et al. | 405/224 |
| 6,022,174 | A * | 2/2000 | Husvik et al. | 405/223.1 |
| 6,106,198 | A * | 8/2000 | Børseth | 405/223.1 |
| 6,203,248 | B1 * | 3/2001 | Childers et al. | 405/224 |
| 6,244,786 | B1 * | 6/2001 | Johansson | 405/224.1 |
| 6,385,928 | B1 | 5/2002 | Paulshus et al. | 52/223.13 |
| 6,457,908 | B1 * | 10/2002 | Bergeron | 405/224 |

OTHER PUBLICATIONS

R.J. Brown, "Drilling and Production Risers Can Be Effectively Installed at a Much Lower Cost Using the Pipeliners Towing Techniques," Nov. 7-9, 2000, pp. 1-13. Deep Offshore Technology.

Shaddy Y. Hanna, Mamdouh M. Salama, and Henrik Hannus, New Tendon and Riser Technologies Improve TLP Competitiveness in Ultra-Deepwater,: Apr. 30-May 3, 2001, pp. 1-9, Offshore Technology Conference.

N.W. Hein, Jr., C.J. Wall, C.D. Young, and D.E. Parks, "Materials, Welding, and Fabrication for the Jolliet Project," May 7-10, 1990, pp. 159-166, Offshore Technology Conference.

M.R. Hornung, S.Y. Hanna, H. Hannus and D. Rowan, "The Heidrun Field—Heidrun TLP Tether System," May 6-9, 1996, pp. 677-688, Offshore Technology Conference.

D.M. Miller, I. Frazer, and P. Brevig, "The Heidrun Field—Marine Operations," May 6-9, 1996, pp. 689-717, Offshore Technology Conference.

P.C. Wybro, S.C. Bultema, and J.L. Mueller, "Installation of the Jolliet Field TLWP," May 7-10, 1990, pp. 167-180, Offshore Technology Conference.

Pascinthe Saad, Ove Jahnsen, and Mamdouh M. Salama, "Application of Composites to Deepwater Top Tensioned Riser Systems," Jun. 23-28, 2002, pp. 1-7, Offshore Mechanics and Arctic Engines.

Mamdouh M. Salama, Ove F. Jahnsen, Per-Ola Baalerud, and Ole Lindefjeld, "Composite Carbon Fiber Tether for Deepwater TLP Applications," Oct. 1999, pp. 1-13, Deep Offshore Technology Conference.

PCT International Search Report, dated Apr. 24, 2003.

Williams, Jerry G, et al.; "Composite Spoolable Pipe Development, Advancements, and Limitations;" OTC 12029; pp. 327-342; May 1-4, 2000; Offshore Technology Conference, Houston, Texas, USA.

* cited by examiner

FLOATING PLATFORM HAVING A SPOOLABLE TETHER INSTALLED THEREON AND METHOD FOR TETHERING THE PLATFORM USING SAME

CROSS-REFERENCE TO RELATED APPLICATIONS

This application claims the benefit under 35 U.S.C. § 119(e) of U.S. Provisional Patent Application No. 60/286,885, filed Apr. 27, 2001, which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to spoolable tethers for anchoring a floating platform or vessel, and in particular a tension leg platform (TLP), to the ocean floor in deepwater and a method for installing the tether. More particularly, the present invention relates to mounting spools of composite tethers directly on a TLP and subsequently unspooling and installing the tethers to anchor the TLP.

BACKGROUND OF THE INVENTION

Tethers (also referred to as cables, tendons, support lines, mooring lines, and the like) are useful for securing floating structures such as TLPs in deepwater. Particularly in depths over about 4000 feet, composite tethers offer significant economic and technical advantages and reliability over steel tethers. Composites such as carbon fibers embedded in a polymer matrix material are lightweight and have high specific strength and stiffness and excellent corrosion and fatigue resistance, which make them attractive for water depth sensitive components such as tethers and risers or umbilicals, which transport hydrocarbons from a wellhead on the ocean floor. Furthermore, composites are easily outfitted with instrumentation such as fiber optics integrated into the composite for load and integrity monitoring.

Conventional composite TLP tethers comprise top and bottom end connectors for connection to the TLP and a foundation on the ocean floor, respectively, and a tether body having a plurality of parallel twisted strands. The twisted strands herein referred to are formed from a twisted assemblage of small, parallel rods having a diameter of about 3–6 mm, and typically comprise in the range of about 50 to 200 rods per strand, wherein the assemblage of rods is subjected to a helical twist, typically about 2 to 3° on the outer rods. The plurality of parallel twisted strands, wherein each strand is typically about 50 to 75 mm in diameter, are also twisted slightly to achieve a helix in the conventional tether, also referred to herein as a twisted tether. The size of the conventional tether is determined by the number of twisted strands, which is dictated by the strength and axial stiffness requirements for a given tether service (e.g., size of the TLP, water depth, ocean currents, storm history, etc.). The number of twisted strands per conventional tether is typically from about 8 to 30 twisted strands per assembled conventional tether. Conventional tethers are twisted as described previously so that they may be wound upon tether spools, typically having a diameter of greater than about 4.0 meters, and preferably from about 4 to 8 meters. In order for the conventional composite tethers to be spoolable, small diameter rods having a diameter of no greater than about 6 mm are required, otherwise the size of the required spool becomes impractical, as described below. The spooled tethers are transported upon reel ships or barges for installation and anchoring of the TLP to the ocean floor.

The manufacturing process of a conventional, spoolable composite tether includes the following steps: fabrication of small diameter composite rods, assembly of the rods into twisted strands, assembly of the twisted tether from multiple twisted strands (including addition of filler and profile material as needed), and termination of the twisted strands in top and bottom end connectors of the tether. The manufacturing of conventional, spoolable composite tethers is described in the following conference paper, which is incorporated by reference herein in its entirety: Composite Carbon Fiber Tether for Deepwater TLP Applications, presented at the Deep Offshore Technology Conference held in Stavanger, Norway on Oct. 19–21, 1999.

Composite materials for rod manufacture consist of small diameter fibers (from about 6 to about 10 microns) of high strength and modulus, preferably carbon fibers, embedded in a polymer matrix material, e.g., resins or glues. Commonly known thermoset or thermoplastic polymeric matrices may be used. Preferred matrix materials include vinylesters and epoxies. The resin materials have bonded interfaces which capture the desirable characteristics of both the carbon fibers and the matrix. The carbon fibers carry the main load in the composite material while the matrix maintains the fibers in the preferred orientation. The matrix also acts to transfer load into the carbon fibers and protects the fibers from the surrounding environment. Carbon fibers incorporated in the matrix may be spun in long continuous lengths; however, short (from about 25 to about 100 mm) discontinuous fibers may also be used. The carbon fibers may be medium and/or high modulus carbon fibers. Low cost, medium modulus (from about 32 msi to about 35 msi) carbon fibers include polyacrylonitrile (PAN) carbon fibers such as those available from Grafil Inc., Toray Industries, Inc, Akzo Nobel, and ZOLTEK, among others. Low cost, high modulus (from about 55 msi to about 80 msi) carbon fibers include those available from Conoco Inc. and Mitsubishi Corp.

Composite rods are typically manufactured by pultruding the composite material comprising the carbon fibers and the polymer matrix material. Pultrusion is the pulling of the resin wetted fibers through a die rather than pushing it through the die as in extrusion processes used for metal manufacturing. The die size and shape control the final size and shape of the pultruded composite product. There are several commercial pultruders such as Glasforms, Inc., DFI Pultruded Composites Inc., Exel Oyj, Strongwell Corp., Spencer Composites Corp., and others that are capable of producing the composite rods. Rods used in conventional spoolable tethers are typically round in cross-section. The composite rods produced typically have a weight which is approximately ⅙ that of required for an equivalent steel rod. As discussed previously, rods for use in conventional composite tethers typically are from about 3 to about 6 mm in diameter and are often wound onto rod spools, for example a 1.8 or 2.2 m diameter rod spool, for transportation to a strand and/or tether manufacturing facility.

In general, it is desirable to increase the stiffness of rods used in a tether, and the stiffness of a rod may be calculated according to the following equation:

$$E \cdot A = \frac{4 \cdot \pi^2 \cdot L \cdot (\text{Vertical Mass} + \text{Added Mass})}{n \cdot T^2}$$

where E=axial stiffness of a rod (Pa); A=cross sectional area of 1 tether ($m^2$); L=water depth (m); n=number of tethers; T=heave natural periods (s), typically from about 5 to about 5.5 seconds; vertical mass=mass of the platform (kg); and added mass=mass of the water that moves when the platform moves (kg). Typically, a stiffer rod cannot be bent as much as a less stiff rod. Given that the rods typically must be wound onto a rod spool for transportation, the bending stiffness of the rod is proportional to the diameter of the rod (d) raised to the fourth power (i.e., $d^4$). Thus, it is necessary to use a small diameter composite rod (i.e., from about 3 to about 6 mm) in order for the resulting rod spool diameter to be a practical size for handling and transport and the force necessary to spool the rod and maintain it on the spool be practical. More specifically, in sizing the rod spool, the strain in the spooled rod is equal to the diameter of the composite rod divided by the diameter of the rod spool. In a properly sized spool, the rod strain is less than 50% of the ultimate strain to failure of the rod. Thus, if the composite rod has 1% strain to failure, then the diameter of the rod spool then needs to be larger than 200 times the diameter of the rod to be able to spool the rod onto the rod spool without damaging the rod. If the composite rod has ½% strain to failure, then the diameter of the rod spool has to be larger than 400 times the diameter of the rod. The diameter of a spool refers to the hub or core of the spool. In sum, where the rod itself must be spooled (or a strand or tether incorporating the rod must be spooled, as discussed below), the diameter and/or the stiffness of the rod must be engineered accordingly.

In a conventional, spoolable composite tether, the rods are assembled into bundles to form twisted strands. The twisted strands can be manufactured using typical wire rope stranding methods. Specifically, the rods are uncoiled from the rod spools and pulled through a guide plate for bundling. When the required number of rods per strand are laid out, the guide plates are rotated to impart a slight helical twist, typically 2 to 3° on the outer rods. Twisting the strand provides sufficient coherence to the strand for handling, coiling and transportation without significantly affecting the axial strength and stiffness. The rods in the twisted strands are fixed into a position by wrapping with tape or other securing device, cut to length and spooled onto strand spools for use in the assembly of the tether body. Generally, twisted strand spools include 1.8 or 2.2 m diameter spools such as those used for rod spools.

The twisted strands are assembled to form a conventional, spoolable composite tether [205] (i.e., a twisted tether) as shown in FIG. 1. The conventional, spoolable tether [205] is made up of multiple twisted strands [215], the twisted strands being further twisted with each other to form the twisted tether [205]. It can be seen that there are a large number of composite rods [210], which are bundled together to form individual twisted strands [215]. In this particular figure, there are fifteen twisted strands [215] making up the twisted tether [205], and a typical conventional tether may include from about 8 to about 30 twisted strands. The twisted strands [215] are held in place by a profiled member [220], which fills the voids between the twisted strands [215] and also provides a means for imparting a helical twist to the plurality of twisted strands [215] (thereby forming the twisted tether [205]). The profiled member [220] is preferably made from a plastic such as polyvinylchloride (PVC) or polypropylene and may be divided into segments such as center profile [225], intermediate profile [230], and outer profile [235]. The profiled member [220] may also contain void spaces [240]. A filler material may be placed in the void space between the twisted strands [215]. Preferred filler according to this invention is foam, which is used to give the tether buoyancy as described below.

The twisted strands [215] are free to move individually in the length direction, allowing individual adjustment and hence a better distribution of axial loads. The composite rods [210] and twisted strands [215] are free to act or move independently in the twisted tether [205]. In other words, there is relative axial movement between adjacent composite rods [210] within a twisted strand [215] and between adjacent composite twisted strands [215] within a twisted tether [205]. Otherwise the entire diameter of the conventional, spoolable tether [205] must be considered in calculating the diameter of the tether spool, since strain relates to the diameter of the body that is being spooled divided by the diameter of the spool, as described previously. By putting a twist in the composite rods [210] (via twisted strands [215] and twisted tether [205]) and keeping them separate and independent, the diameter of the individual composite rods [210] can roughly be used to calculate the diameter of the tether spool rather than the entire diameter of the twisted tether [205]. Typically, however, the tether spool is made somewhat larger to account for the friction between adjacent composite rods [210] as the conventional tether is spooled onto the tether spool.

As shown in FIG. 2, different size twisted strands [216] and [217] may be used to better fit all the twisted strands [216] and [217] inside an outer jacket or casing [245]. Preferably, the area within the casing [245] is filled by twisted strands [216] and [217] and empty void spaces are minimized. The twisted strands [216] and [217] are typically at least 30% of the area of the conventional, spoolable tether [205] and more typically 50% of the area of the tether [205]. Typically, the profiled member [220] and any filler material do not add any performance characteristics to the twisted tether [205], and thus it is desirable to minimize such components as much as possible to avoid unwanted additional weight and increased size.

The assembly of the conventional, spoolable tether [205] is performed using a conventional umbilical closing machine. Spools containing the twisted strands [215] and the profiled members [220] are lifted onto the closing machine. The twisted strands [215] and the profiled members [220] are then pulled through closing plates. During this process, the machine rotates to impart a helical twist in the twisted strands [215] to form the twisted tether [205]. A yarn or other securing device is then applied to hold the assembly together prior to extrusion of the protective, outer jacket [245] such as high density polyethylene (HDPE), nylon, or the like over the twisted strands to hold the twisted strands in place and protect the tether during handling. Conventional, spoolable tethers may be manufactured as a single continuous body that is spooled onto a spool. Alternatively, the tether body may be manufactured as a plurality of body lengths or segments that are spooled onto a spool. The segments are connected with connectors (e.g., couples or collars) to create a continuous tether. Segmenting the tether is helpful in accommodating production of rods, strands, and tethers, in limiting spool size, and in readjusting tether length for re-installations.

The final step of manufacturing a conventional, spoolable composite tether is the termination process that includes connecting the twisted tether to top and bottom end connectors. Termination using resin-potted cones has been extensively used in the wire rope industry. Resin terminations have been proven to be successful for terminating composite twisted strands as well. The twisted strands are fastened to a steel end connector using a potted cone technique similar to that used for termination of steel wires. The twisted strands are spread with a specific angle in the steel cones, and the cone is then filled with epoxy resin. A vacuum injection method is used in this process to avoid air gaps and to ensure consistent molding. Use of a flexible cone and cylindrical metal connector with spacers can minimize the effect of termination bending and provide better rod distribution inside the end connector. Alternatively, the twisted strands may be individually terminated and then assembled into a tether. After termination, the tether is spooled onto an appropriately sized conventional tether spool having a drum diameter of from about 4 to 8 m and a width of about 5 m, for transportation and installation offshore. An appropriately sized tether spool should be selected based upon the characteristics of the composite rods as described previously.

Heretofore spooled tethers have been transported upon reel ships or barges for installation and anchoring of a platform such as a TLP to the ocean floor. For example, a reel ship is used to unwind and lay down a spooled composite tether and another support vessel is typically required to assist the connection of the tether to the foundation and TLP. The process using reel ships is similar to that used to lay down and install umbilicals. Use of support vessels such as barges and reel ships is expensive, requires complicated logistical scheduling, and results in longer installation times, thereby subjecting the installation to an increased risk for complications due to bad weather. The present invention eliminates these problems and simplifies the installation process by placing the spooled composite tether directly upon the TLP for transportation and installation at a designated site.

SUMMARY OF THE INVENTION

The present invention includes a process for installing a floating platform to the ocean floor using a spoolable composite tether, comprising: installing the spooled tether onto the floating platform; towing the floating platform to a site for installation; unspooling the tether; connecting a bottom end connector of the tether to a foundation on the ocean floor; and connecting a top end connector of the tether to the floating platform. A preferred floating platform is a tension leg platform. The spooled tether installed on the floating platform may further comprise a spool holder, a spool (also referred to as a reel or carousal) having a tether wound thereon installed on the spool holder, and a means for winding and unwinding the spool connected to and driving the spool. The spooled tether may further comprise a constant tension winch having a wire line connected to the top end connector of the tether.

In a preferred embodiment the foundation is a suction anchor, and the suction anchor is connected to the bottom end connector prior to unspooling the tether and attached to the ocean floor after unspooling the tether. The tether may be divided into a plurality of lengths, each length being spooled onto one of a corresponding plurality of spools, the tether being connected together with connectors as the lengths thereof are unspooled.

The present invention includes a process for uninstalling, moving and re-installing a floating platform to the ocean floor using a spoolable composite tether, comprising: disconnecting a top end connector of the tether from the floating platform; disconnecting a bottom end connector of the tether from a foundation on the ocean floor; spooling the tether onto a spool installed on the floating platform; towing the floating platform to a different site for re-installation; and unspooling the tether and re-installing the tether to the ocean floor and the floating platform. In a preferred embodiment of the reinstallation process, the foundation is a suction anchor, the bottom end connection remains connected to the suction anchor, and the suction anchor is released from the ocean floor and raised to the surface as the tether is spooled onto the spool.

The invention includes a novel tension leg platform (TLP) comprising a spooled composite tether installed thereon. The spooled composite tether may further comprise a spool holder, a spool having a tether wound thereon installed on the spool holder, and a means for winding and unwinding the spool connected to and driving the spool. The spooled composite tether may further comprise a constant tension winch having a wire line connected to a top end connector of the tether. The spooled composite tether may be mounted above or below the waterline, for example temporarily mounted to the TLP hull, permanently mounted to the TLP hull, temporarily mounted to the TLP deck, or permanently mounted to the TLP deck.

DETAILED DESCRIPTION OF THE INVENTION

Figure 1:
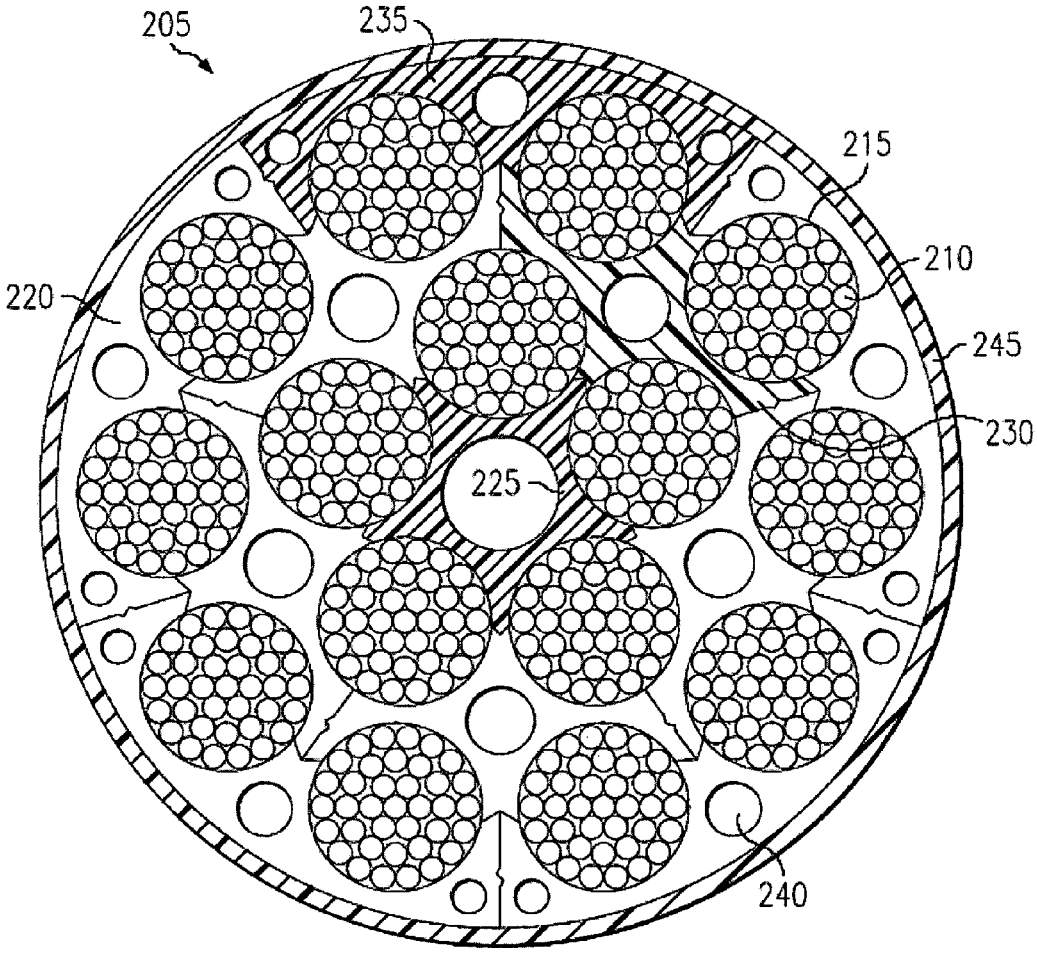
FIG. 1 (PRIOR ART)
FIG. 1 is a cross-sectional view of a conventional, spoolable composite tether having same sized strands of rods.
Figure 2:
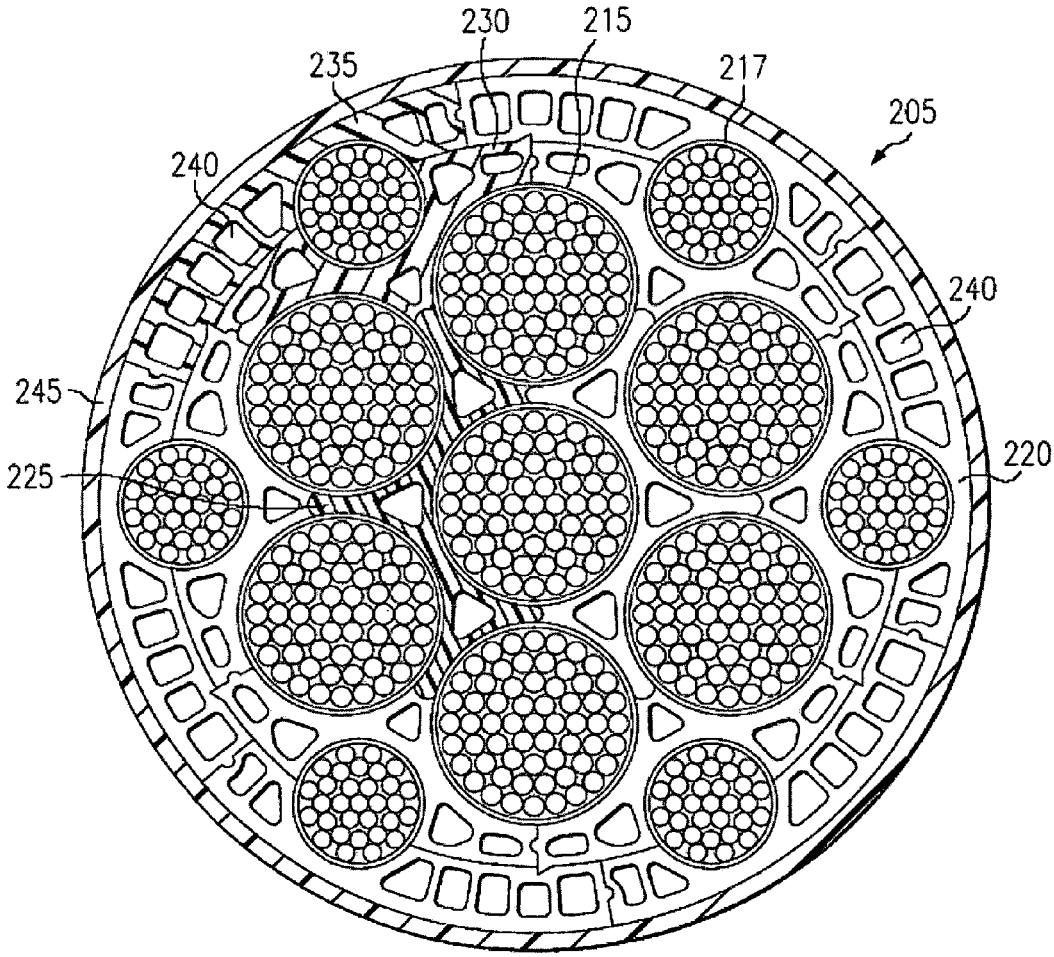
FIG. 2 (PRIOR ART)
FIG. 2 is a cross-sectional view of a conventional, spoolable composite tether having differing sized strands of rods.
Figure 3:
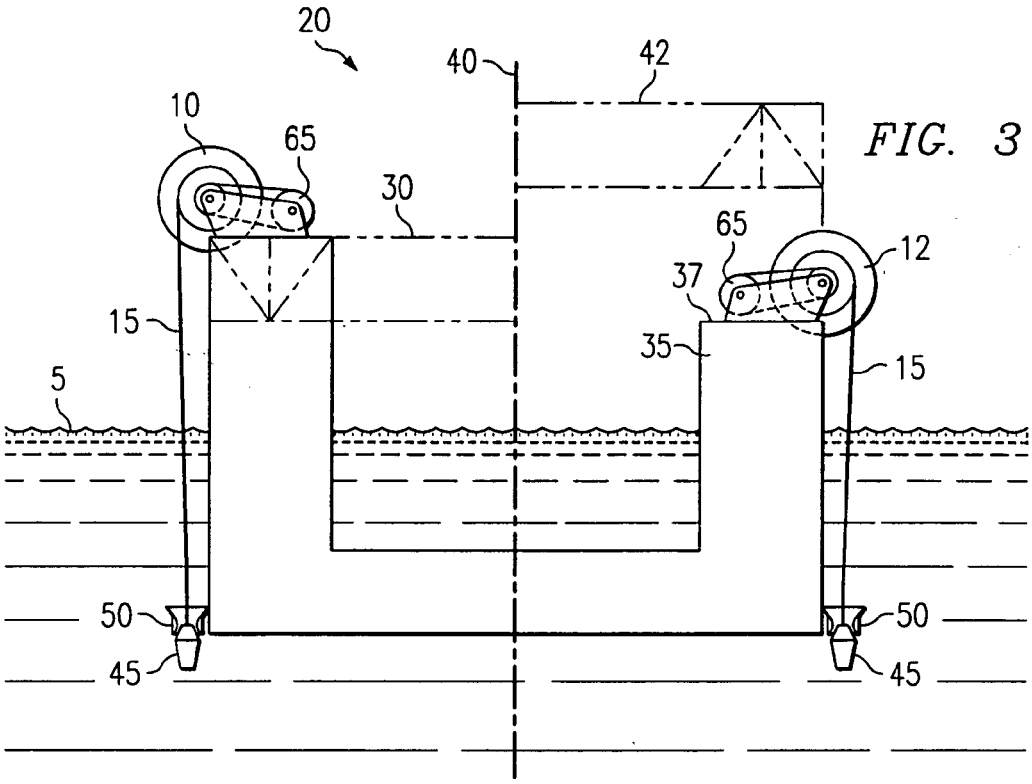
FIG. 3 is a side view showing spooled composite tethers installed on a TLP configured for tow.

According to the present invention as embodied in FIG. 3, spools [10] and [12] containing the composite twisted tethers [15] are installed directly on a platform floating on the ocean surface [5]. In a preferred embodiment the floating platform is a tension leg platform (TLP) [20] that is to be towed offshore and anchored to the seabed. The spool [10] typically rests upon a spool holder [25] such as a drum or carousel having a horizontal rod supported at either end and having a controllable means to wind and unwind the twisted tether [15] from the spool [10], such as a motor and a brake (not shown). The spool holder [25] can be installed permanently or temporarily on the TLP, and likewise the spool [10] can be installed permanently (i.e., fixed spool) or temporarily (i.e., removable or exchangeable spool) to the spool holder [25]. Where the spool [10] is removeable, the spool holder [25] should be configured for receipt and removal of the spool [10]. The bottom end connectors [45] of the twisted tethers [15] are held securely during transportation of the TLP, preferably by stowing them in tether porches [50] connected to the lower portion of the hull [35], below the location of the spool [10]. The tether porches [50] also serve as the connection point for the top end connection of the twisted tether upon installation.

Figure 3A:
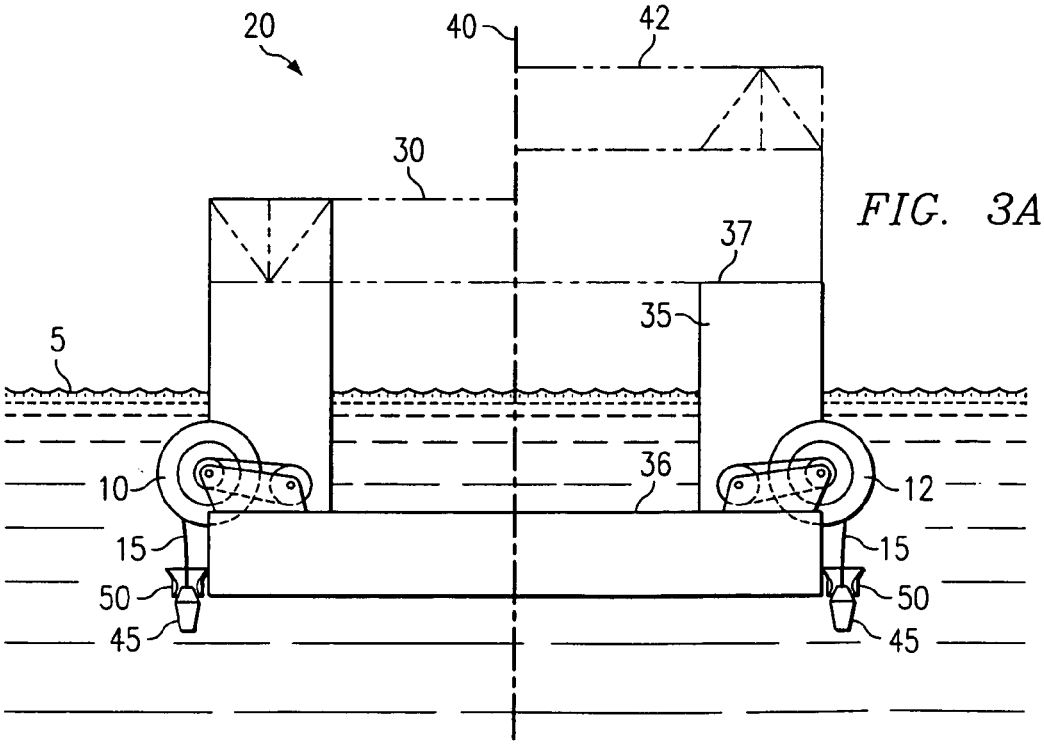
FIG. 3A is a side view showing spooled composite tethers installed below the waterline on a TLP.

As shown in FIG. 3, the spools may be installed on top of the deck portion [30], as shown by spool [10]. Alternatively, where the deck has not yet been installed (for example, where the hull is towed to a location without a deck), the spool may be installed on top of the hull [35], as shown by spool [12]. For hull installations, the spools may be located above the waterline, for example spool [12] mounted on top of a column [37] as shown in FIG. 3, or below the waterline [5], for example spools [10] and [12] mounted on an underwater pontoon portion [36] of the TLP hull [35] as shown in FIG. 3A or mounted near the tether porches [50]. Where the spools are installed underwater, the open ends of the spools may be sealed to provide buoyancy and thereby minimize their weight supported by the platform. Divider line [40] is used in FIG. 3 to show both the on deck and on hull spool locations on a single TLP. Deck portion [42] is shown suspended above spool [12] to demonstrate where the deck portion [42] would be placed after spool [12], which in this case is installed temporarily, has been removed following installation of the twisted tether [15]. Preferably the spools are installed while the TLP is on or near the shore, for example by using cranes at a shipyard or other construction facility located at a dock, pier, or harbor. After the spools have been installed and other construction completed, the TLP is launched (provided that it has not been previously launched during construction) and towed to an offshore installation site.

Figure 4:
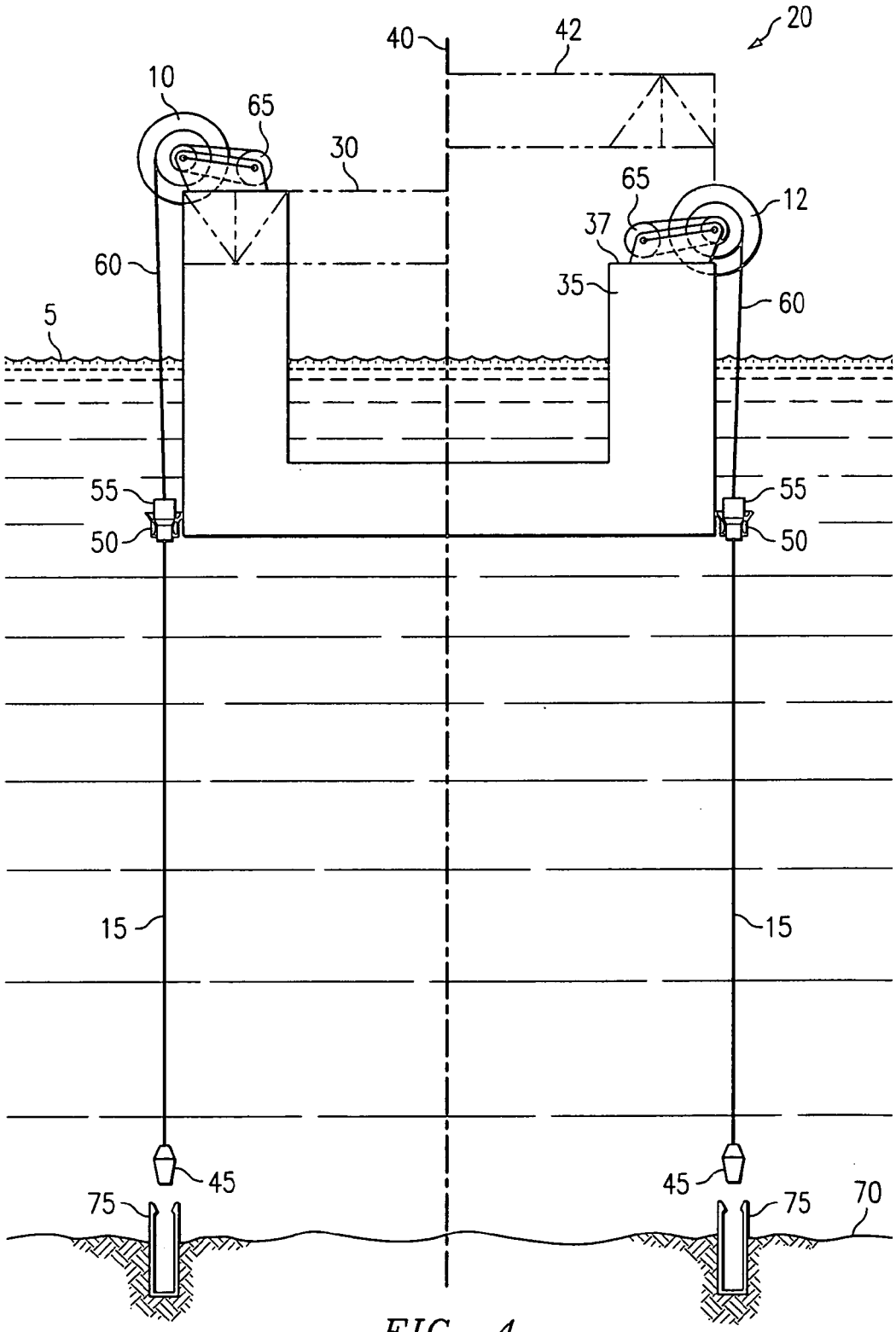
FIG. 4 is a side view showing spooled composite tethers installed on a TLP being connected to foundations on the seabed.

Upon reaching the installation site, the TLP [20] can be positioned and held in place by the towing vessels, while the twisted tethers [15] are unwound from the spools [10] and [12] and the bottom end connectors [45] of the twisted tethers [15] are lowered to the ocean floor [70], as shown in FIG. 4. The bottom end connectors [45], being configured for such, are received by and coupled with preset foundations [75], as are known in the art. The foundation [75] may be, for example, a preset foundation such as a pile, template, suction anchor or the like. The top end connectors [55] of the twisted tethers [15] are connected to wire lines [60] (preferably before the twisted tether [15] is completely unspooled to prevent the twisted tether from sinking to the ocean floor [70]), which in turn are wound onto constant tension winches [65]. The top end connectors [55] are configured for receipt by and coupling with the tether porches [50]. The wire lines [60] and constant tension winches [65] place tension on the twisted tethers [15] during the installation process, thereby helping to transition the platform from free-floating to TLP mode.

Before connecting the top end connectors [55] of the twisted tethers [15] to the tether porches [50], the constant tension winches [65] are activated in combination with the addition of ballast, and the TLP [20] sinks lower in the water (i.e., the draft of the TLP is increased). The top end connectors [55] of the twisted tethers [15] are connected to the tether porches [50], and the draft is reduced through deballasting until the correct draft of the TLP [20] and tension on the tethers are maintained. Typically, a plurality of twisted tethers [15] are installed to hold the floating platform securely in position. Upon installation of the twisted tethers [15], the wire lines [60] may be disconnected from the top end connectors [55], and the spools [10] and [12], spool holders [25], and constant tension winches [65] may be removed to free up space on the TLP. Alternatively, this equipment may remain installed upon the TLP, for example for use in moving and reinstalling the TLP at another site.

Helpful background information regarding subsea installation of tethers is disclosed in the following articles each of which is incorporated by reference herein in its entirety: OTC 8100: The Heidrun Field—Heidrun TLP Tether System, presented at the Offshore Technology Conference held in Houston, Tex. on May 6–9, 1996 (P. 677–688); OTC 8101: The Heidrun Field—Marine Operations, presented at the Offshore Technology Conference held in Houston, Tex. on May 6–9, 1996 (P. 689–717); OTC 6361: Materials, Welding, and Fabrication for the Jolliet Project, presented at the Offshore Technology Conference held in Houston, Tex. on May 7–10, 1990 (P. 159–166); and OTC 6362: Installation of the Jolliet Field TLWP, presented at the Offshore Technology Conference held in Houston, Tex. on May 7–10, 1990 (p. 167–180).

Figure 5:
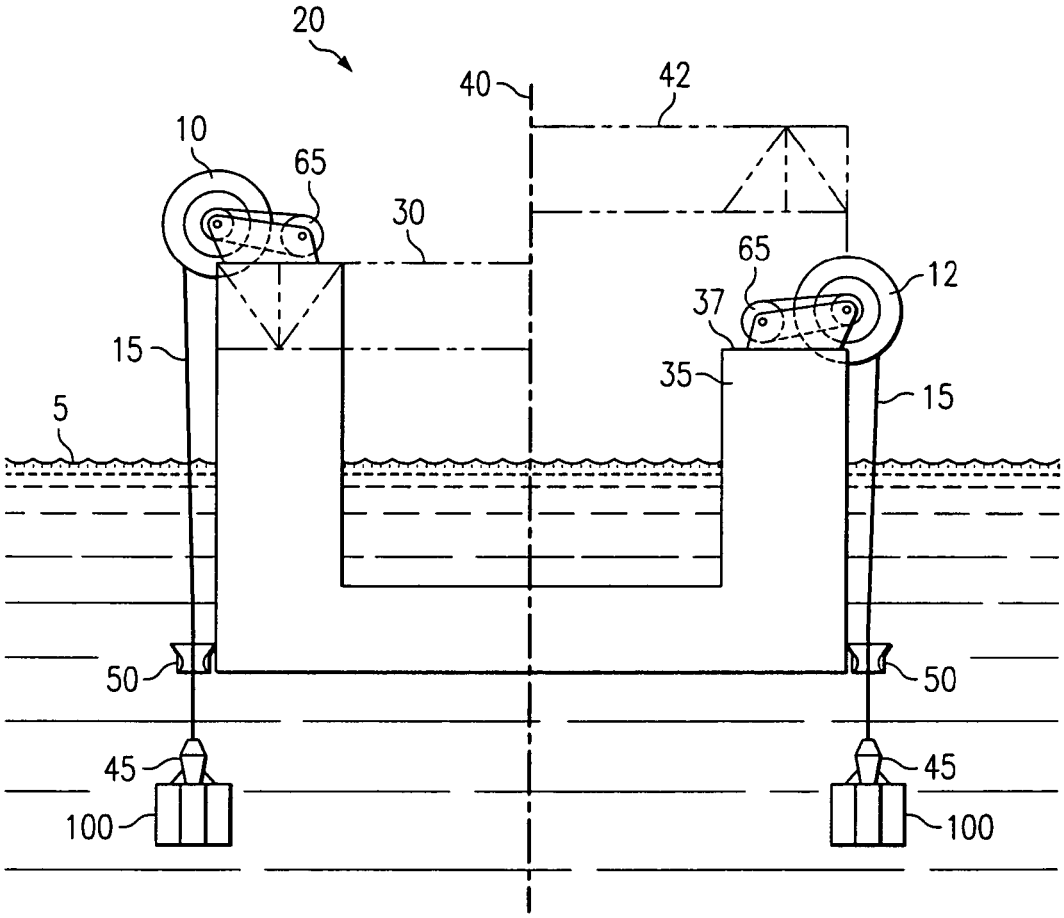
FIG. 5 is a side view showing spooled composite tethers installed on a TLP configured for tow, wherein suction anchors are attached to the bottom end connectors of the tethers.

FIG. 5 shows an alternative embodiment for attaching the twisted tether [15] to the ocean floor. Suction anchors [100], as known in the art, are attached to bottom end connections [45] while twisted tethers [15] are wound on spools [10] and [12]. Preferably, the suction anchors [100] are attached after the spools [10] and [12] are installed and while the TLP [20] is still on or near the shore. FIG. 5 shows the TLP configured for towing to the installation site with the suction anchors [100] already attached. Alternatively, the TLP could be towed configured as shown in FIG. 3, and the suction anchors [100] attached at the installation site prior to unwinding the twisted tethers [15].

Figure 6:
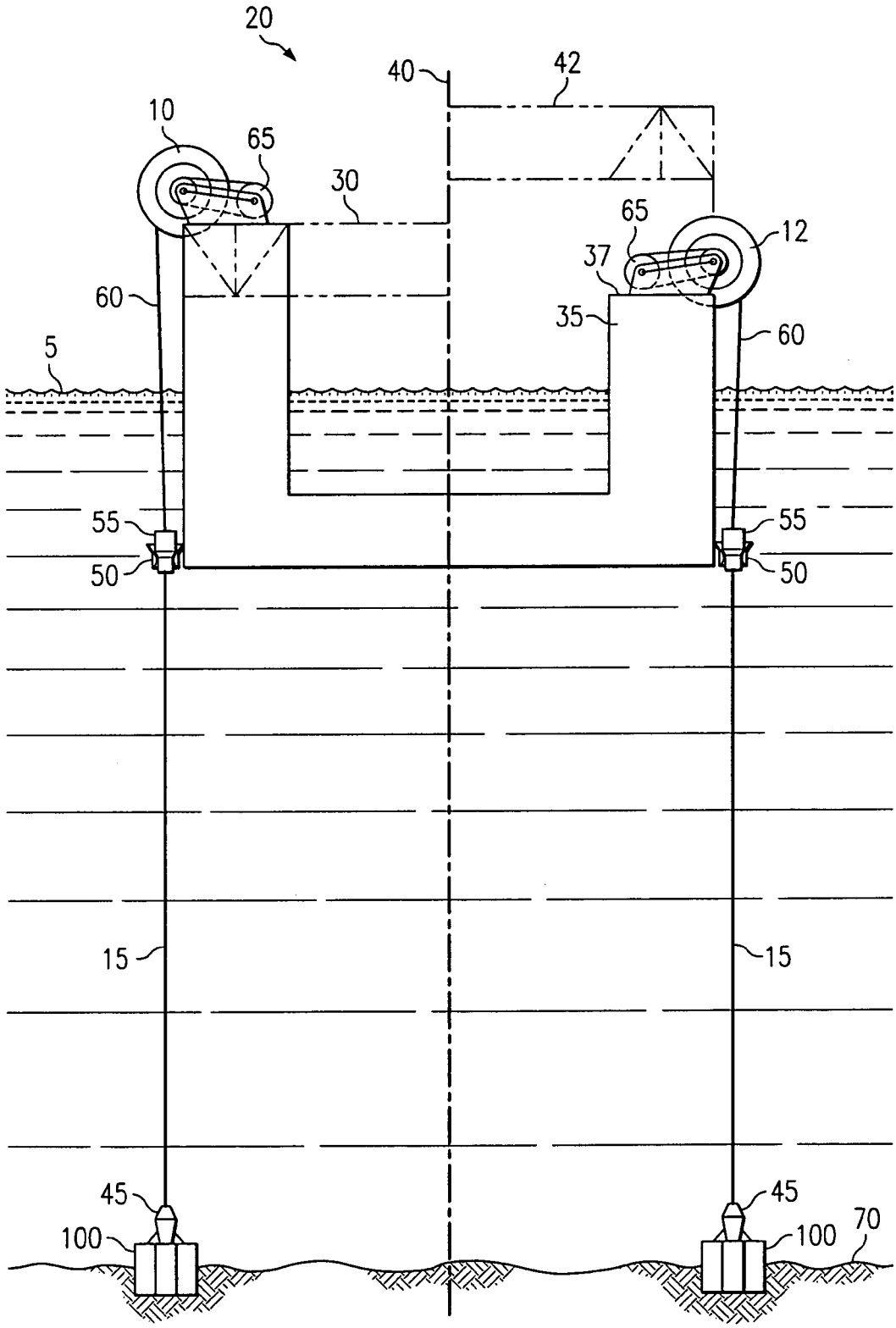
FIG. 6 is a side view showing spooled composite tethers installed on a TLP wherein suction anchors attached to the bottom end connectors are being installed in the seabed.

Upon reaching the installation site, the TLP can be positioned and held in place by the towing or other vessels, while the twisted tethers [15] are unwound from the spools [10] and [12] and the bottom end connectors [45] and the suction anchors [100] are lowered to the ocean floor [70]. As shown in FIG. 6, the suction anchors [100] hold to the ocean floor [70] like a suction cup. An extending portion or chamber of the suction anchors [100] is pushed into the ocean floor and mud is removed from inside the chamber to create a vacuum, thereby securely attaching the suction anchors [100] and bottom end connectors [45] of the twisted tethers [15] to the ocean floor. The remaining installation of the twisted tethers [15] is performed as described above in reference to FIG. 4.

The installation process described previously may be reversed to uninstall the twisted tethers, freeing the TLP to be towed to another site and reinstalled by re-performing the installation processes described previously. A different water depth can be accommodated by changing spools, tethers, or both, or by using different segment lengths if the tether body is segmented. More specifically, the spools [10] and [12], spool holders [25], and constant tension winches [65] are reinstalled, if previously removed. The wire lines [60] are reconnected to the top end connectors [55], and the draft of the TLP is increased by adding ballast. The top end connectors [55] of the twisted tethers [15] are disconnected from the tether porches [50]. The wire lines [60] hold the top ends of the twisted tethers [15] during the uninstallation process, thereby ensuring that the twisted tethers [15] remains relatively stable and do not fall to the ocean floor [70]. The ballast is removed and the wire lines [60] loosened to allow the TLP to float on the surface. The wire lines [60] are slackened further and the bottom end connectors [45] (or optionally the suction anchors [100]) are detached from the ocean floor [70]. The twisted tethers [15] are winched up and the top ends thereof threaded onto the spools [10] and [12]. The motors for winding the spools [10] and [12] are engaged, and the twisted tethers [15] are wound up and out of the ocean and onto the spools. Preferably, but not necessarily, the twisted tethers [15] are wound completely or substantially completely out of the water to reduce drag and risk of damage during towing to another location. After all of the twisted tethers [15] have been uninstalled, the floating platform can be towed to another location and reinstalled. Where reuse and/or reinstallation of the tethers is desired, preferably composite, twisted tethers are used as such are typically more corrosion resistant as compared to steel tethers.

Preferably, the twisted tether is a continuous length wound upon a single spool. However, the twisted tether may be divided into a plurality of lengths or segments, wound upon a corresponding plurality of spools, and connected as the tether lengths are unwound during installation to form a continuous twisted tether. Mechanical connectors or collars may be used to connect the twisted tether lengths without adversely impacting the strength or performance of the twisted tether.

EXAMPLE

Figure 7:
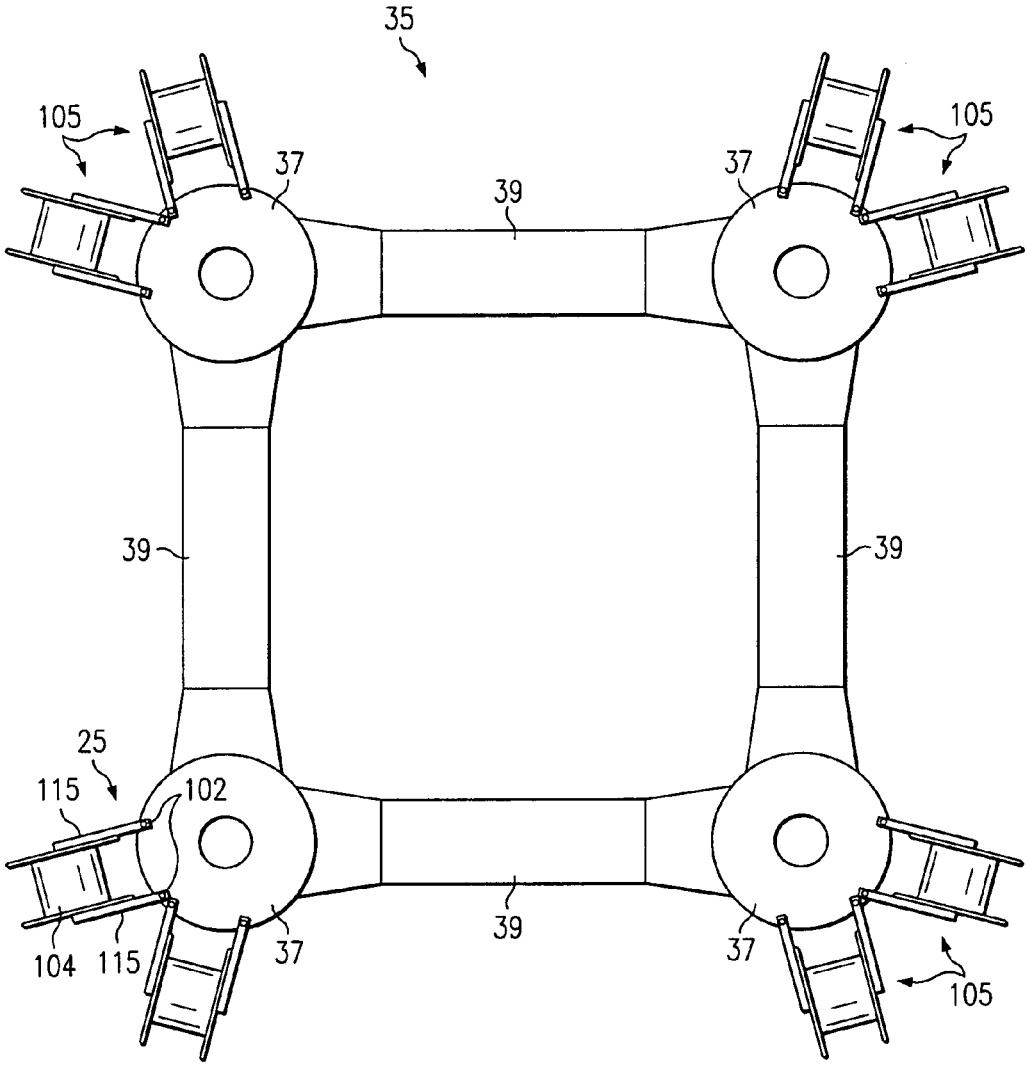
FIG. 7 is a top view showing two spooled tethers releasably mounted at each corner of a TLP.
Figure 8:
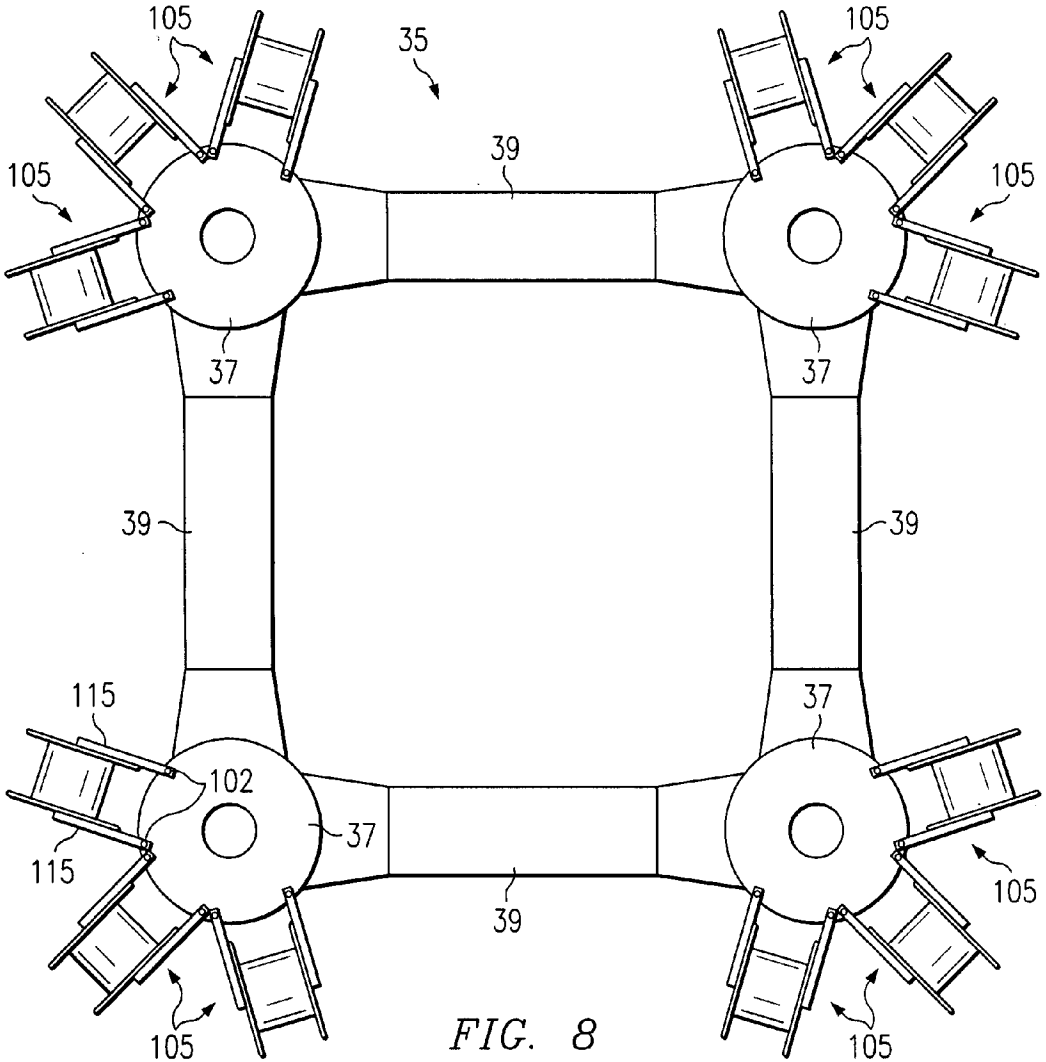
FIG. 8 is a top view showing three spooled tethers releasably mounted at each corner of a TLP.

In this example, a plurality of spooled tethers, preferably composite twisted tethers, are mounted on the top of a TLP hull at deck level and installed as follows. Similar installation procedures may be used when the spool is mounted at other locations on the TLP, including underwater. FIGS. 7 and 8 are top views of a TLP hull [35] without the deck installed, the TLP being generally rectangular in shape and having four corners with a column [37] at each corner and supports [39] extending between the columns [37]. Spool assemblies [105], as described in more detail below, are mounted on the TLP hull [35], preferably with at least one spool assembly [105] located at each corner of the TLP. In the embodiment shown in FIG. 7, two spool assemblies [105] are mounted on each column [37] for a total of 8 on the TLP. In the embodiment shown in FIG. 8, three spool assemblies [105] are mounted on each column [37] for a total of 12 on the TLP. The spool assemblies [105] are preferably mounted at about the same relative position and orientation at each corner such that the TLP is subjected to about equal loads and forces upon installation.

Figure 9:
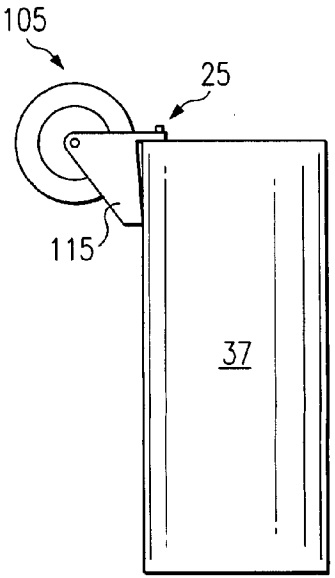
FIG. 9 is a side view of a spooled tether releasably mounted at deck level on a TLP.
Figure 10:
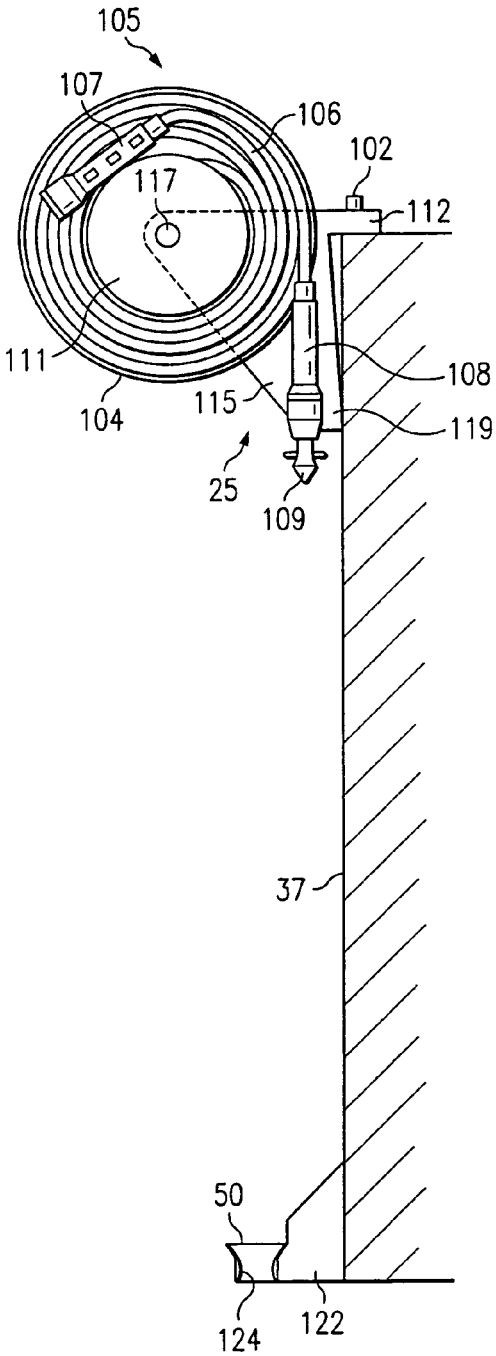
FIGS. 10–17 are side views showing the installation sequence of a spooled tether on a TLP.

FIG. 9 is a side view of one corner of the TLP with a mounted spool assembly [105] extending outward from the side of the column [37] such that the mounted spool assembly [105] does not interfere with deck placement on top of the column [37]. Alternatively, the spool assembly [105] may be mounted on top of the column [37] as shown by spool [12] in FIG. 3, on top of the deck [30] as shown by spool [10] in FIG. 3, or underwater on the pontoon portion [36] or tether porch [50] as shown in FIG. 3A. Referring to the close-up view of the corner [37] of FIG. 10, the mounted spool assembly [105] is in a retracted position. The spool assembly [105] comprises a twisted tether [106] spooled around spool [104], which is supported by spool holder [25], also known as a spool cradle. The spool holder [25] preferably is equipped with or connected to hydraulically operated drive machinery, not shown. As shown in FIG. 7, the spool holder [25] comprises a pair of support members [115], with one positioned on each side of the spool [104]. Referring to FIG. 10, a support bar [117] extends between the pair of support members [115] and supports the spool [104]. Each support member [115] has a lip portion [112] that extends over the edge of column [37] and a lower body portion [119] that extends downward from the lip portion [112] and engages the side of column [37] when mounted thereon. The spool holder [25] is releasably mounted on column [37] by means of a hole in lip portion [112] that receives a pin [102] extending upward from the top of column [37]. The twisted tether [106] has a top end connector [107] and a bottom end connector [108], which is connected to a bottom connector assembly (BCA) [109]. The top end connector [107] is attached to the spool [104] by support wires [120] wrapped around the core [111] of spool [104], not shown in FIG. 10 but visible in FIG. 11.

Preferably, the spool assemblies [105] are mounted on the TLP prior to beginning the installation process, for example while the TLP is still at dock. Preferably, the BCAs [109] are pre-installed while the twisted tether [106] is in a retracted position, for example while the TLP is at dock or during transport. When the TLP has been towed to the installation site and is ready to be installed, the draft of the TLP is increased by adding ballast (e.g., seawater). The additional draft preferably is more than the maximum heave of the TLP during installation, for example about 2 m below normal draft.

Figure 11:
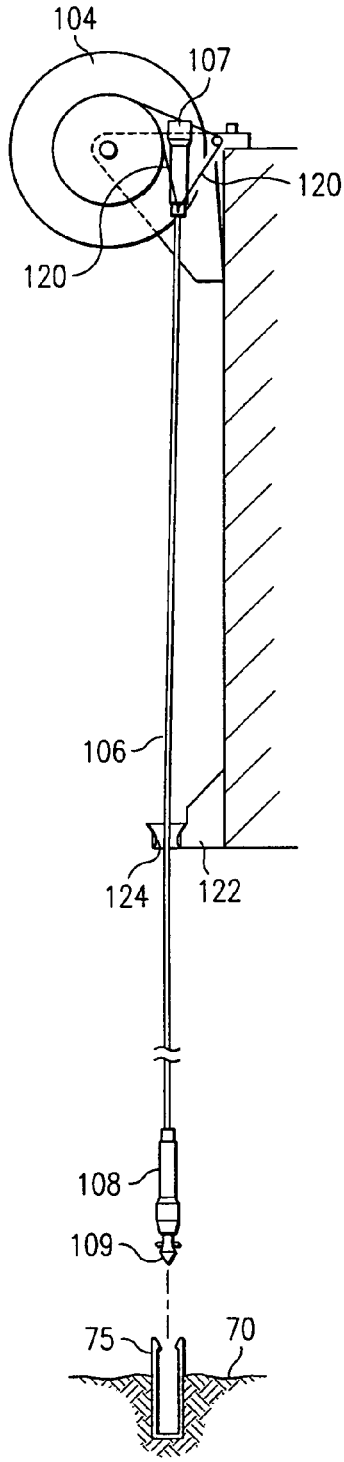

To deploy and install the twisted tether, the twisted tether [106] is slowly unwound from the spool [104] via the hydraulic drive machinery, thereby lowering the BCA [109] down toward the tether porch [50]. The tether porch [50] comprises a guide funnel [122] and a bore [124] having a diameter large enough to allow the BCA [109] and bottom end connector [108] to pass through. As the twisted tether [106] is unwound, the BCA [109] is lowered and comes into contact with the guide funnel [122], whereby the BCA [109] and bottom end connector [108] are guided into and pass through bore [124], as shown in FIG. 11. Unwinding of the twisted tether [106] continues until the entire length of the twisted tether [106] is laid out, as shown in FIG. 11. Upon completion of unwinding, the top end connector [107] is held in place by support wires 120, preferably steel, and the BCA [109] is positioned some meters above the foundation [75] in the ocean floor [70].

Figure 12:
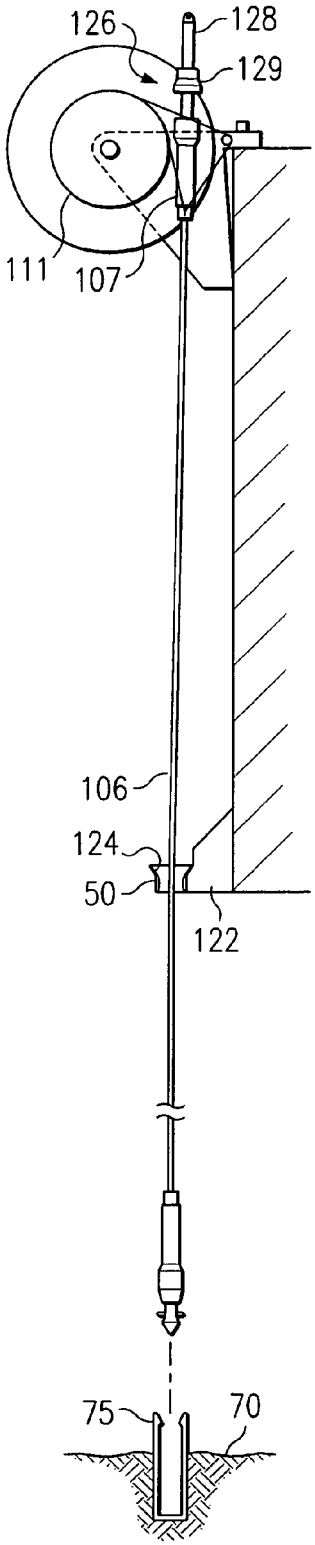
Figure 13:
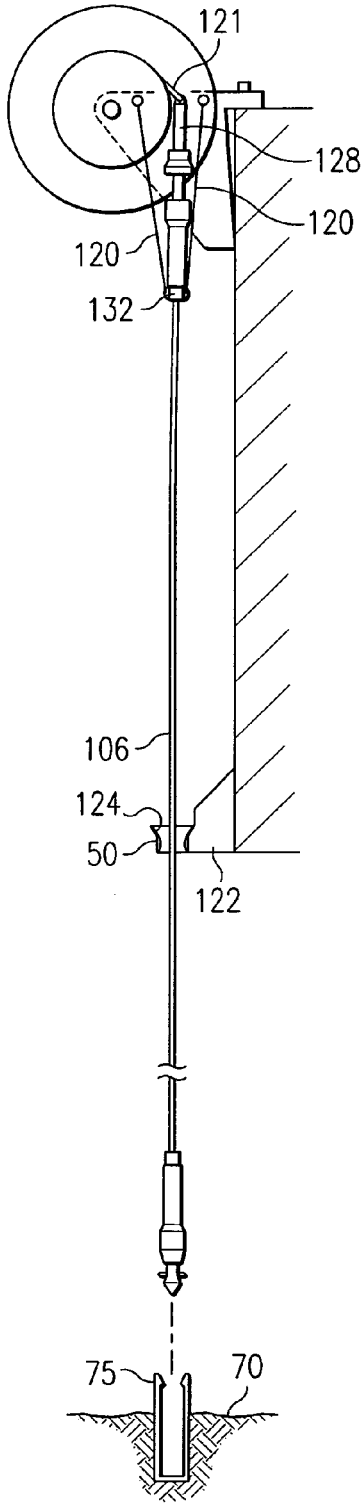
Figure 14:
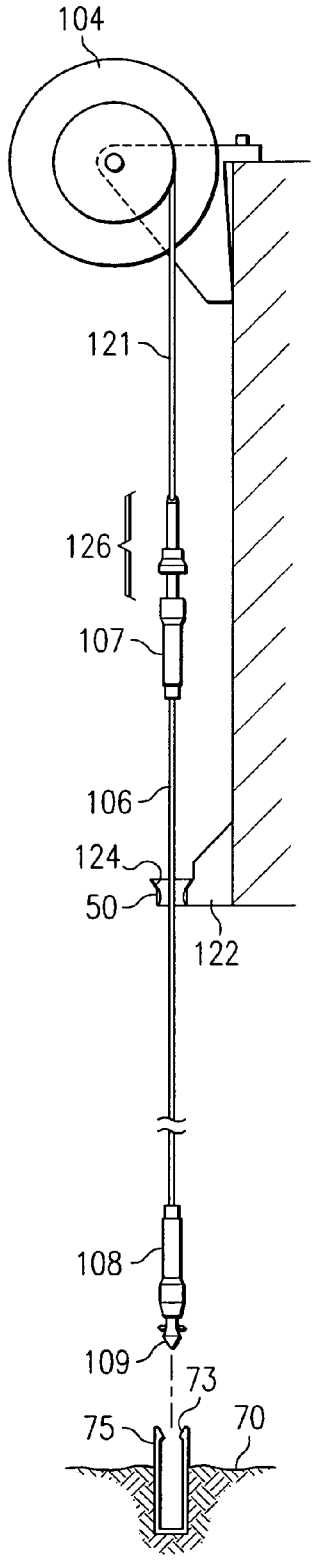
Figure 15:
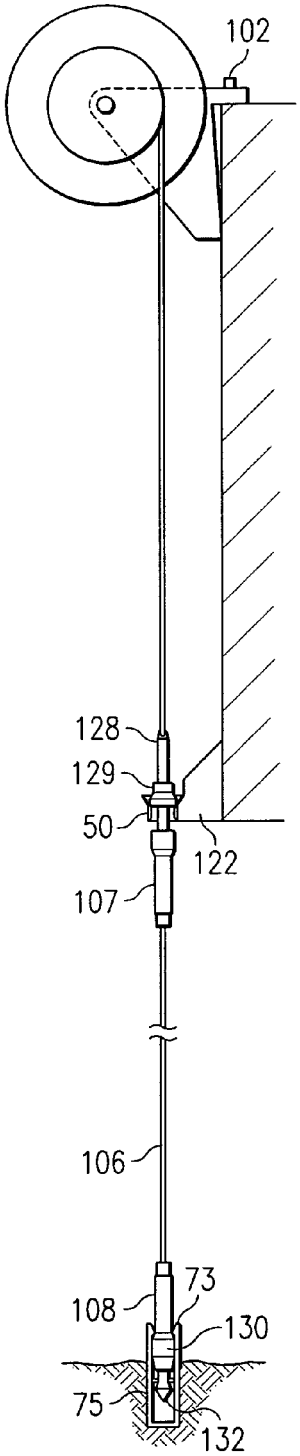

Referring to FIG. 12, a top connector assembly (TCA) [126] is connected to the top end connector [107], the TCA [126] comprising a length adjusting joint [128] with a split nut [129]. Typically, the TCA [126] also comprises a flex element (not shown) such as a laminated rubber molding that acts as a universal joint with low bending stiffness to minimize the bending moment applied to the twisted tether [106] as the platform moves relative to the foundation [75]. As shown in FIG. 13, the TCA [126] is lowered and supported by a sling of support wires [120] connected to collar [132] while a lowering wire [121] is attached to the top of length adjusting joint [128]. The lowering wire [121] has a minimum length of about equal to, and preferably greater than, the distance between the spool [104] and the tether porch [50]. As shown in FIG. 14, the twisted tether [106] is lowered via lowering wire [121] by unwinding spool [104] until the BCA [109] mates with a receptacle in the foundation [75] and the TCA [126] seats in the tether porch bore [124]. The BCA [109] is typically guided into position by a working remote operating vehicle (WROV), and the TCA [126] is guided into position by the guide funnel [122]. The twisted tethers [106] are typically pre-sized based upon the water depth and normal draft of the TLP. Since the TLP has an additional draft of about 2 m, the BCA [109] during this phase of the installation will typically be a corresponding about 2 m below its final service position, as shown in FIG. 15 where both the head [132] and the shoulder [130] of the BCA [109] are within the receptacle of the foundation [75]. Additional lowering wire [121] is unspooled to slacken the wire. The tether deployment and installation process is repeated until all twisted tethers [106] have been deployed and connected to the foundation [70] in the ocean floor and the TLP. Given that all twisted tethers [106] are slack during the installation process, the TLP is held in place (i.e., kept in station) by an array of towing vessels.

Figure 16:
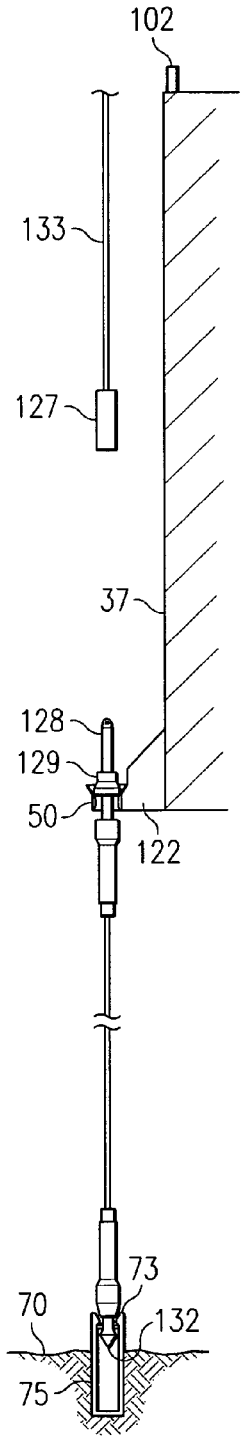

Preferably, at least one twisted tether [106] at each corner has an integral tether tension monitoring system (TTMS) that is connected prior to tensioning the twisted tethers. The TTMS may be connected temporarily, for example by a cable clamped to the lowering wire [121], or permanently, for example by a cable extending down from the deck to the tether porch [50] and connected to a wet mate connector on the TCA [126]. The twisted tethers [106] are tensioned by deballasting the TLP (i.e., pumping out seawater), and deballasting continues until the BCAs [109] are properly engaged in their foundations [75] and about normal tether tension is obtained in the twisted tethers [106], as indicated by the TTMS. As shown in FIG. 16, the BCA [109] is properly engaged when the head [132] of the BCA [109] is in contact with a locking surface [73] at the top of the receptacle in foundation [75].

Upon completion of deballasting, the twisted tether tension may be further adjusted or "fine-tuned" through use of the length adjusting joint [128] and split nut [129] on TCA [126]. A tension adjustment tool (TAT), as is known in the art, is launched from an installation support vessel and maneuvered by WROV onto the TCA [126]. The TAT is used to adjust the position of the split nut [129] up or down on the length adjusting joint [128], thereby adjusting the tension in the twisted tether [106], which is monitored via the TTMS. The process is continued until all twisted tethers [106] have been adjusted, as needed, and the TAT is returned to the support vessel.

Figure 17:
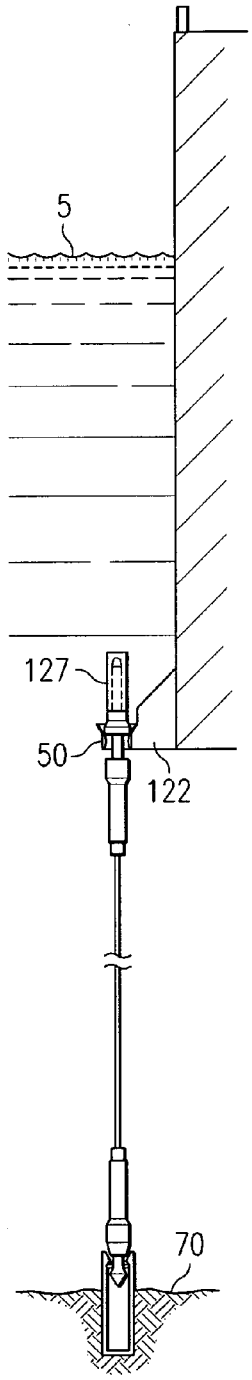

The twisted tethers [106] having been deployed, installed, and tensioned, the remaining elements of the spool assemblies [105] are removed from column [37], for example by use of a crane on a support vessel. The crane lifts the spool assembly [105] vertically until the spool holder [25] exits the pins [102] on top of column [37]. FIG. 16 shows column [37] and pin [102] after removal of the spool assembly [105]. As shown in FIGS. 16 and 17, a corrosion cap [127] is lowered (for example, by a crane on a support vessel) by a wire [133], threaded onto the length adjusting joint [128], and filled with corrosion inhibitor, thereby protecting the length adjusting joint [128] and split nut [129] from corrosion, debris, and impact. The TCA [126] may be further protected from corrosion by sacrificial anodes. Removal of the spool assemblies [105] may alternatively be postponed until after installation of the corrosion caps [127], and in an alternative embodiment the lowering wire [121] may be used to lower the corrosion cap [127]. FIG. 17 shows the completed installation of a twisted tether [106].

While preferred embodiments of the invention have been shown and described, modifications thereof can be made by one skilled in the art without departing from the spirit and teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

The invention claimed is:

1. A process for anchoring a floating platform to the ocean floor comprising: installing a spooled tether onto the floating platform, wherein the tether is a composite, twisted tether that connects to a tether porch on the floating platform when the tether is installed to anchor the floating platform, wherein the tether porch is the connection point on the floating platform for a top end connector of the tether.

2. The process of claim 1 further comprising towing the floating platform to a site for installation; unspooling the tether; connecting a bottom end connector of the tether to a foundation on the ocean floor; and connecting a top end connector of the tether to the floating platform.

3. The process of claim 2 wherein unspooling the tether results in an empty spool, and further comprising removing the empty spool from the floating platform.

4. The process of claim 2 wherein the foundation is a suction anchor, and the suction anchor is connected to the bottom end connector prior to unspooling the tether and attached to the ocean floor after unspooling the tether.

5. The process of claim 2 further comprising: disconnecting the top end connector of the tether from the floating platform and the bottom end connector of the tether from the foundation on the ocean floor; spooling the tether onto a spool installed on the floating platform; towing the floating platform to a different site for re-installation; and unspooling the tether and reconnecting the tether to the ocean floor and the floating platform.

6. The process of claim 5 wherein the foundation is a suction anchor, the bottom end connector remains connected to the suction anchor, and the suction anchor is released from the ocean floor and raised to the surface as the tether is spooled onto the spool.

7. The process of claim 5 wherein the spool is mounted upon the floating platform prior to disconnecting the tether and removed upon reconnecting the tether.

8. The process of claim 5 further comprising changing the spooled tether to accommodate a different water depth at the site for re-installation.

9. The process of claim 5 further comprising tensioning the tether.

10. The process of claim 2 wherein the bottom end connector is stowed in the tether porch when towing the platform to the site for installation.

11. The process of claim 2 further comprising tensioning the tether.

12. The process of claim 1 wherein the floating platform is a tension leg platform (TLP).

13. The process of claim 12 wherein the spooled tether is temporarily installed on the TLP hull.

14. The process of claim 13 wherein the spooled tether is installed above the waterline.

15. The process of claim 13 wherein the spooled tether is installed below the waterline.

16. The process of claim 15 wherein a spool of the spooled tether has sealed ends such that the spool is buoyant when installed underwater.

17. The process of claim 12 wherein the spooled tether is permanently installed on the TLP hull.

18. The process of claim 17 wherein the spooled tether is installed above the waterline.

19. The process of claim 17 wherein the spooled tether is installed below the waterline.

20. The process of claim 19 wherein a spool of the spooled tether has sealed ends such that the spool is buoyant when installed underwater.

21. The process of claim 12 wherein the spooled tether is temporarily installed on the TLP deck.

22. The process of claim 12 wherein the spooled tether is permanently installed on the TLP deck.

23. The process of claim 1 wherein the spooled tether installed on the floating platform further comprises a spool holder, a spool having the tether wound thereon supported by the spool holder, and a means for winding and unwinding the spool connected to and driving the spool.

24. The process of claim 1 wherein the tether is divided into a plurality of lengths, each length being spooled onto one of a corresponding plurality of spools, the tether being connected together with connectors as the lengths thereof are unspooled.

25. The process of claim 1 wherein the spooled tether is installed on the floating platform when the platform is on or near shore.

26. A tension leg platform (TLP) comprising a spooled tether installed thereon, wherein the tether is a composite, twisted tether that connects to a tether porch on the TLP when the tether is installed to anchor the TLP to the ocean floor, wherein the tether porch is the connection point on the floating platform for a top end connector of the tether.

27. The TLP of claim 26 wherein the spooled tether further comprises a spool holder, a spool having the tether wound thereon supported by the spool holder, and a means for winding and unwinding the spool connected to and driving the spool.

28. The TLP of claim 26 wherein the spooled tether is temporarily installed on the TLP hull.

29. The TLP of claim 28 wherein the spooled tether is installed above the waterline.

30. The TLP of claim 28 wherein the spooled tether is installed below the waterline.

31. The TLP of claim 26 wherein the spooled tether is permanently installed on the TLP hull.

32. The TLP of claim 31 wherein the spooled tether is installed above the waterline.

33. The TLP of claim 31 wherein the spooled tether is installed below the waterline.

34. The TLP of claim 26 wherein the spooled tether is temporarily installed on the TLP deck.

35. The TLP of claim 26 wherein the spooled tether is permanently installed on the TLP deck.

36. The TLP of claim 26 further comprising at least one spooled tether installed at each corner of the TLP.

37. The TLP of claim 26 wherein the spooled tether comprises a bottom end connector and a top end connector.

38. The TLP of claim 37 further comprising a suction anchor connected to the bottom end connector.

39. A floating platform tether spool having sealed ends such that the spool is buoyant when installed underwater.

40. The tether spool of claim 39 wherein the spool is installed on a tension leg platform (TLP) hull.

* * * * *